United States Patent [19]

Kahn

[11] Patent Number: 4,747,141

[45] Date of Patent: May 24, 1988

[54] AM STEREO SIGNAL DECODER

[76] Inventor: Leonard R. Kahn, 137 E. 36th St., New York, N.Y. 10016

[21] Appl. No.: 544,752

[22] Filed: Oct. 24, 1983

[51] Int. Cl.[4] ..... H04H 5/00

[52] U.S. Cl. ..... 381/11; 381/12; 381/15

[58] Field of Search ..... 381/15, 10, 11, 2, 3, 381/4, 12; 332/55

[56] References Cited

U.S. PATENT DOCUMENTS

| | | | |
|---|---|---|---|
| 3,169,229 | 2/1965 | Ulzurrun | 332/55 |
| 3,557,309 | 1/1971 | Graham | 381/107 |
| 3,729,693 | 4/1973 | Dolby | 381/107 |
| 4,018,994 | 4/1977 | Kahn | 381/15 |
| 4,192,968 | 3/1980 | Hilbert et al. | 381/15 |
| 4,466,116 | 8/1984 | Streeter | 381/15 |

FOREIGN PATENT DOCUMENTS

| | | | |
|---|---|---|---|
| 58-104543 | 6/1983 | Japan | 381/11 |

*Primary Examiner*—Forester W. Isen
*Attorney, Agent, or Firm*—Edward A. Onders

[57] ABSTRACT

A simplified stereo signal decoder is disclosed for use in an AM stereo receiver which receives composite AM stereo broadcast signals comprising a radio frequency carrier wave having amplitude modulation representing stereo sum (L+R information and phase modulation representing stereo difference (L-R) information. The decoder makes novel use of a common, commercially available integrated circuit (IC) that normally is used as a tone detector or a frequency-modulation (FM) detector. The decoder provides synchronous detection of the (L-R) information, combined two-mode phase-locked loop (PLL) recovery of the carrier component and enabling of the (L-R) signal output, and delayed enabling of the (L-R) signal output for a "stereo bloom" effect. The decoder is particularly useful for decoding independent sideband (ISB) AM stereo broadcast signals.

12 Claims, 2 Drawing Sheets

AM STEREO SIGNAL DECODER

BACKGROUND OF THE INVENTION

This invention relates to a signal decoder and more particularly to a stereo signal decoder for use in a receiver which is capable of receiving compatible AM stereo radio frequency (RF) broadcast signals, wherein an RF carrier has amplitude modulation (AM) representing stereo sum (L+R) information and phase modulation (PM) representing stereo difference (L−R) information.

In my prior U.S. Pat. No. 4,018,994, an AM stereo receiver is disclosed for obtaining L and R information from an independent sideband (ISB) AM stereo broadcast signal of the above-described type. In such an ISB signal, left (L) stereo information is transmitted primarily in the lower sidebands of the composite modulated RF signal and right (R) stereo information is transmitted primarily in the upper sidebands of the composite RF signal. This results from a 90° phase relationship that is introduced between the L+R and L−R modulating signals prior to their being used to amplitude and phase modulate, respectively, the RF carrier at the transmitter. In one type of ISB receiver, a corresponding 90° phase difference is introduced between the demodulated L+R and L−R signals before they are matrixed to produce L and R output signals. The disclosure of U.S. Pat. No. 4,018,994 is incorporated herein by reference.

The receiver shown in my prior U.S. Pat. No. 4,018,994 is shown as being constructed from a plurality of separate electronic circuit components and achieves low distortion decoding of a received AM stereo signal by using a distortion cancelling technique in the stereo decoder. In accordance with one aspect of that technique, a received composite intermediate frequency (IF) ISB signal is inversely amplitude modulated as a function of the demodulated (L+R) signal. The resulting altered IF signal is applied to a synchronous quadrature detector, together with an IF reference signal that is developed by a PLL arrangement, where the phase modulation is demodulated to develop a distortion corrected (L−R) signal. The L+R and L−R signals are applied to a pair of 90° phase difference networks and then matrixed to develop left (L) and right (R) stereo audio output signals.

In constructing AM stereo receivers of the aforementioned type it would be desirable to implement the stereo decoder using a single custom-built IC which incorporates all or many of the necessary circuit functions. Although this would substantially reduce space, power, cooling and weight requirements, the capital investment and time required to design and produce such a custom IC is substantial. Alternatively, therefore, it would be desirable to be able to use an existing, low-cost, readily available IC as the basis for AM stereo decoder configurations which would require far fewer discrete circuit components.

It would also be desirable to be able to implement such a simplified decoder using a PLL arrangement which will not introduce an undesirable tuning characteristic in continuously tunable stereo receivers. Generally, this requires some form of muting in the L−R signal path of the decoder during initial tuning of the receiver to a stereo station.

Accordingly, it is an object of the present invention to provide a simplified AM stereo signal decoder which makes novel use of an existing, low-cost IC to perform functions different from those for which it is intended.

It is another object of the present invention to provide an AM stereo signal decoder which incorporates a novel two-mode PLL configuration that has a wide pull-in range until the PLL is locked to the IF signal carrier component, and thereafter has a narrower hold-in range while the PLL remains locked to the received carrier. This PLL configuration also provides enabling of the stereo difference signal output when the decoder is in a condition for properly decoding stereo information.

It is still another object of the present invention to provide an AM stereo signal decoder which incorporates a novel "stereo bloom" feature whereby upon initially being tuned to a stereo broadcast the receiver operates in a monophonic mode and thereafter, following a selected perceptible delay, changes to a stereo mode.

SUMMARY OF THE INVENTION

In accordance with one aspect of the present invention an improved stereo radio receiver is provided which is capable of operating in monophonic (mono) and stereophonic (stereo) reception modes. In such a receiver there is provided means for determining whether the receiver is in a condition for properly decoding stereo information from a received signal and for developing a control signal indicative thereof. The receiver also includes means responsive to the control signal and controlling the translation of decoded stereo information in the receiver, for enabling such translation at a selected perceptible time after the control signal indicates that the receiver is in a condition for properly decoding stereo information. Such a receiver initially operates in its mono mode upon being tuned to a station before changing its stereo mode.

In accordance with another aspect of the invention, the control signal responsive means also changes an impedance in a phase-locked loop (PLL) which is part of the stereo information decoder. The change not only causes the PLL to operate in a first mode until locked to the carrier of a supplied IFF signal and, after the above-mentioned selected time interval, to then operate in a second and different mode, but also controls translation of the decoded stereo information.

In accordance with still another aspect of the invention, such a receiver having the above-mentioned characteristics is implemented using an existing, conventional tone and frequency decoder integrated circuit.

The invention is particularly useful in connection with demodulating an AM stereo signal which is an independent sideband signal wherein left and right stereo information is primarily contained in lower and upper sidebands, respectively.

For a better understanding of the present invention, together with other and further objects, reference is made to the following description, taken in conjunction with the accompanying drawings, and its scope will be pointed out in the appended claims.

DESCRIPTION OF THE INVENTION

Figure 1:
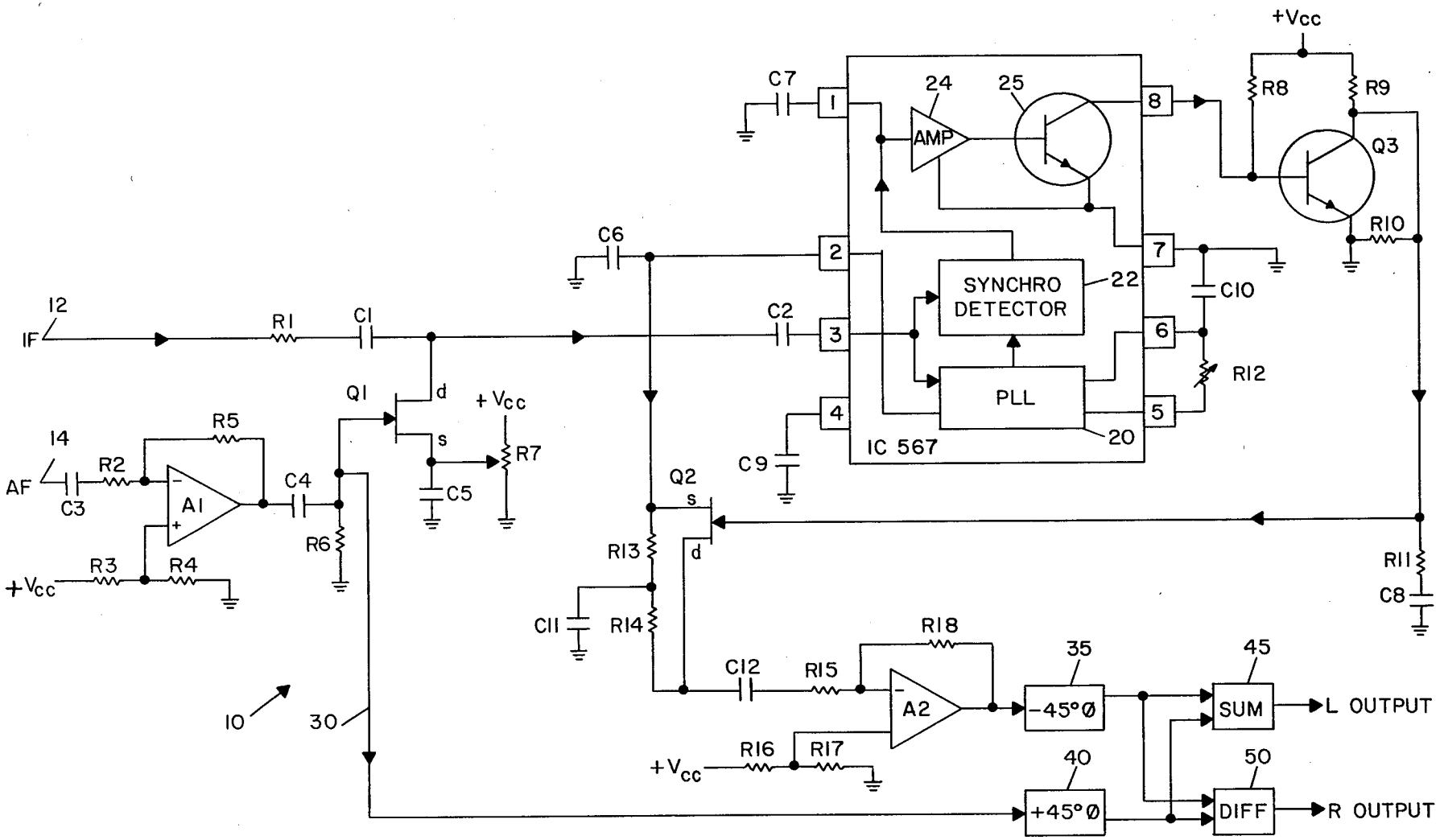
FIG. 1 is a schematic diagram of an AM stereo decoder embodying the present invention in one form.

FIG. 1 is a schematic diagram of a simplified AM stereo decoder 10 in accordance with the present invention. The particular decoder illustrated in FIG. 1 is arranged for decoding independent sideband (ISB) AM stereo signals. It should be recognized, however, that the present invention can be used in constructing decoders suitable for decoding other types of AM stereo signals which contain amplitude modulation representative of L+R information and angle modulation, e.g. phase or frequency modulation, representative of L−R information.

The heart of the decoder illustrated in FIG. 1 is an existing, low-cost IC known as a "567" tone detector, which is available from several manufacturers including Signetics (NE/SE 567), National Semiconductor (LM 567), and others. The "567" IC is intended for use as a tone and frequency decoder, but the present invention makes novel use of this IC for detecting the phase modulation component of composite intermediate frequency (IF) AM stereo signals.

The "567" IC includes a phase-locked loop (PLL) 20, a quadrature detector 22, an amplifier 24, and an output transistor 25. For a detailed description of this IC, reference is made to the technical literature published by the several manufacturers of this type IC.

Figure 2:
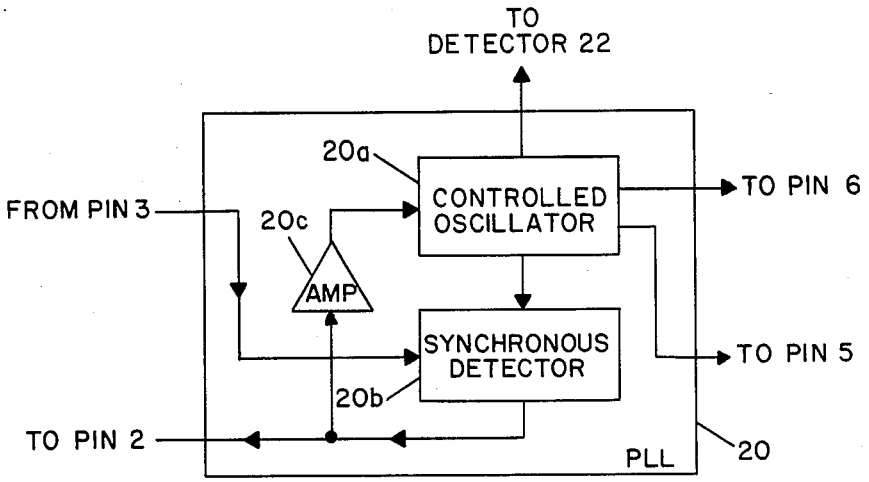
FIG. 2 is a functional block diagram showing the PLL 20 of FIG. 1 in greater detail.

The decoder shown in FIG. 1 is arranged for use in an AM stereo receiver wherein the received RF signal, with composite amplitude and phase modulation, is frequency converted to a corresponding IF signal. The supplied IF composite signal is coupled to terminal 3 of the "567" IC via components R1, C1, C2. Within the IC and IF composite signal is coupled to an input of PLL 20, which generates a reference signal that becomes locked in frequency and phase synchronism to the carrier component of the received composite IF signal. PLL 20 is shown in greater detail in FIG. 2. External circuit components R12 and C10 are provided to tune the PLL's oscillator 20*a* so as to have a free-running frequency that corresponds to the IF frequency of the receiver in which the decoder of FIG. 1 is used. Typically this IF frequency is of the order of 450 KHz, or 260 KHz in some automotive receivers. Actually, Oscillator 20*a* develops a pair of output signals which are substantially in quadrature with respect to each other.

Phase-locked loop 20 includes a synchronous detector 20*b* in its control loop. The output signal from detector 20*b* is also available at terminal 2 of the IC. When PLL 20 is locked, the AC component of this signal corresponds to the phase deviation between the supplied IF signal and the reference signal generated by the PLL's oscillator, which is in quadrature with the phase of the carrier of the supplied IF signal. Accordingly, the signal available at terminal 2 will have audio frequency amplitude components which correspond to any phase modulation in the supplied IF signal, in addition to low frequency components which correspond to any phase deviation between the PLL's oscillator 20*a* and the carrier frequency in the supplied IF signal. The low frequency components are used in the PLL's control loop to maintain oscillator 20*a* in phase lock with the carrier of the IF signal that is supplied to IC pin 3. In the case where the IF signal is an ISB AM stereo signal, for example, since synchronous detector 20*b* operates as a quadrature detector with respect to the supplied composite IF signal, the audio frequency components at IC pin 2 will represent the L−R or stereo difference signal information in the received signal.

The second IF reference signal developed by oscillator 20*a* in PLL 20 is supplied to synchronous detector 22. When the PLL is locked, this reference signal is in phase with the carrier of the supplied IF signal. Therefore, detector 22 provides an output signal representative of the in-phase component of the supplied composite IF signal. This output signal is supplied to threshold amplifier 24 and output transistor 25, which provides at IC pin 8 a binary control signal indicating when the PLL oscillator is locked to the carrier frequency of the supplied IF signal.

Capacitor C7 serves as a low-pass filter for the phase detected signal supplied to amplifier 24, and serves to prevent rapid on and off switching of the output signal at pin 8. Such switching might occur during initial tuning of the receiver to an AM broadcast station because of transient signal outputs from synchronous detector 22.

Capacitor C6, in conjunction with resistors R13, R14, R15, capacitors C11, C12 and operational amplifier A2 provides low-pass filtering for the signal from the output of the synchronous detector 20*b* in PLL 20. By controlling FET transistor Q2, the effective impedance presented by these elements at terminal 2 of the IC can be changed, which affects the response characteristics of the PLL, as will be explained later.

Transistor Q3, with its associated resistors R8, R9, R10, and R11 and capacitor C8, provides an inversion and a time delay for the binary control signal which is output from pin 8 of the IC. Transistor Q3 is "on", or conducting, when the binary signal at pin 8 is high, indicating that the PLL is not yet locked. When in the "on" condition, transistor Q3 grounds the gate of transistor Q2, thereby rendering Q2 non-conducting. When the binary signal at terminal 8 goes low, indicating that the PLL is locked, transistor Q3 turns off and capacitor C8 starts to charge through resistors R9, R10 and R11. Capacitor C8 and resistors R9, R10 and R11 serve as a delay circuit, so that a voltage sufficient to turn on FET $Q_2$ will appear at the gate input of Q2 only after a selected time period determined by selection of the values of capacitor C8 and resistors R9, R10, and R11. In the preferred embodiment these values are chosen such that the time period is on the order of one second, but this time period can be made longer or shorter as desired. It should be particularly noted that in the arrangement shown in FIG. 1, control of FET transistor Q2 provides both audio muting of the stereo difference signal translating channel during initial locking of the PLL and a variable impedance at terminal 2 of the IC.

Because of the manner in which transistor Q2 is coupled between pin 2 of the IC, where the demodulated stereo difference (L−R) information is available, and amplifier A2, when Q2 is non-conducting (while PLL 20 is out-of-lock), the result is a muting of this stereo difference signal path during this period. Then, when detector 22 senses lock-in of PLL 20, this is indicated by a change in the state of the binary signal from pin 8. This change is delayed by the previously mentioned delay circuit and thereafter gates transistor Q2 into a conducting state. This enables the stereo difference signal translation path by allowing the stereo difference signal (L−R) component from pin 2 of the IC to be coupled through to phase shift network 35 by the combination of AC coupling capacitor C12, which has a large value of capacitance, and OP-AMP A2, where the signal is coupled to the inverting (−) input which presents a virtual ground for the lower frequency PLL control components that are also present at pin 2 of the IC. The amplified L−R signal is phase shifted in network 35 and coupled to sum and difference circuits 45 and 50, respectively, where it is combined with the phase shifted L+R signal to develop stereo L and R audio output signals.

Thus, upon initially tuning the receiver of FIG. 1 to an AM stereo station the receiver will operate in a monophonic reception mode until PLL 20 locks to the IF carrier frequency of the received signal. Then after a selected delay, determined by the delay circuit comprising elements C8, R9, R10, R11, the receiver will change to its stereophonic mode of operation. When the delay is made long enough to be clearly perceptible, this intentional delay of stereo operation is referred to as the "stereo bloom" feature, in that the sound heard becomes "fuller" when receiver operation switches from mono to stereo. The sharpness of the transition can also be controlled if desired, so as to be either abrupt or a gradual smooth change from mono to stereo.

An additional function performed by transistor Q2 is to change the load impedance seen at terminal 2, which changes the response characteristics of PLL 20 by changing the time constant in the PLL's control loop. Before the PLL is locked to the carrier frequency of the IF signal, the signal at IC pin 2 is oscillatory, and the network consisting of capacitors C6, C11, C12 with resistors R13, R14, R15 provides a relatively high impedance at IC pin 2. When PLL 20 becomes locked, transistor Q2 is gated into a conducting state, which changes the impedance presented at IC pin 2, providing a longer time constant for the PLL, so that the PLL will have a slower tracking response than it previously had. As a result, PLL 20 operates in two modes. In a first mode, PLL 20 has a wider bandwidth and shorter time constant (when the loop is not yet locked) for better signal acquisition performance, and in the second mode the PLL has a narrower bandwidth and longer time constant (when the loop is locked) for less susceptibility to noise during normal operation of the stereo decoder.

Figure 3:
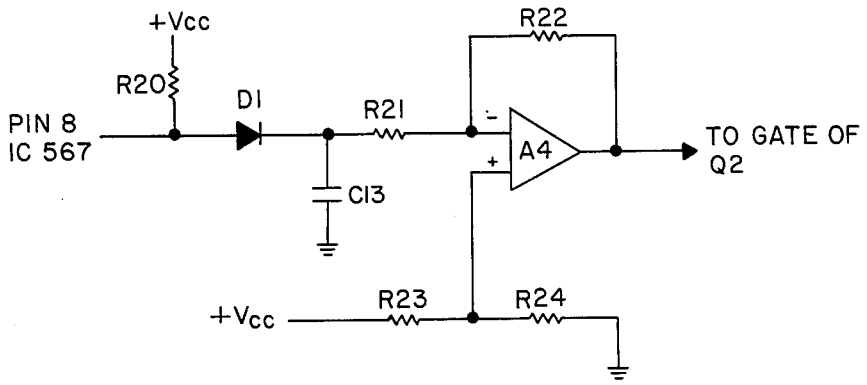
FIG. 3 is a schematic of an alternative interface circuit which may be used with the IC of FIG. 1 in place of the interface circuit (Q3 and associated components) shown in that Figure.

FIG. 3 shows an alternative circuit for connection between IC pin 8 in FIG. 1 and the gate terminal of FET transistor Q2. The circuit of Figure 3 provides a delay in the output of signal from terminal 8 for turning on transistor Q2, but it provides a rapid turn off of transistor Q2 when PLL 20 loses lock.

The output of IC pin 8 is high prior to PLL 20 being locked and this charges capacitor C14 through diode D1. When lock is achieved, pin 8 goes to a low voltage level, near ground, and capacitor C14 slowly discharges through resistors R21 and R22. When the output of pin 8 is in its high state, the output of differential amplifier A4 is low, so that transistor Q2 is in a non-conducting state. When pin 8 goes to its low state, the output of amplifier A4 rises slowly as capacitor C14 discharges. When pin 8 goes to its high state again, because phase lock has been lost in the PLL, capacitor C14 is rapidly charged through resistor R20 and didode D1. Accordingly, the circuit as shown in FIG. 3 provides a slowly rising voltage level to the gate of transistor Q2 in response to a change in the output of IC pin 8 from a high to a low binary state. The slowly rising gate voltage delays the turn on of FET transistor Q2 and, therefore, delays the enabling of the stereo difference signal channel, thereby providing the "stereo bloom" effect. Then, when the PLL loses lock, the output from IC pin 8 changes from low to high and, because the output of amplifier A4 drops rapidly, transistor Q2 is turned off, or becomes non-conducting, rapidly. This provides fast muting of the stereo difference signal channel when the PLL loses lock.

The specific decoder configuration shown in the circuit diagram of FIG. 1 is configured to demodulate an independent sideband, or ISB, AM stereo signal. The circuit includes a FET transistor Q1 which is arranged to provide inverse modulation of the composite IF signal in accordance with the teachings of my prior U.S. Patent which was referenced earlier herein. The circuit further includes phase shift networks 35 and 40 arranged to introduce a 90° relative phase difference between the stereo sum and difference signals prior to their being combined in the sum and difference matrix circuits 45 and 50, where stereo audio output signals L and R are developed. In the circuit of FIG. 1, a composite IF signal is supplied to input terminal 12, and an amplitude demodulated audio frequency (AF) signal containing stereo sum information (L+R) is supplied to input terminal 14. The latter may have been derived from the composite IF signal using a conventional envelope detector, for example.

The input stereo sum signal is coupled to amplifier A1, whose output is AC coupled jointly to the gate terminal of FET $Q_1$ and to the input of phase shift network 40. The input amplifier A1 receives a reference voltage from a voltage divider comprising resistors R3 and R4 connected between the supply voltage $V_{cc}$ and ground. Amplifier A1 also has a feedback resistor R5.

FET Q1 has its drain terminal coupled to the IF input lead between capacitors C1 and C2. Its source terminal is coupled to the supply voltage $V_{cc}$ through variable resistor R7 bypassed by C5. As a result, Q1 presents a variable impedence for the composite IF signal present at its drain terminal. Since this impedance is controlled by the L+R signal applied to the gate of FET Q1, the result is that the composite IF signal available at the junction between capacitors C1 and C2 will be inversely amplitude modulated by the L+R signal, provided L+R is supplied in the correct phase. This accomplishes distortion cancellation in accordance with the teachings of my prior U.S. Pat. No. 4,018,994 referenced earlier herein. The inversely modulated composite IF signal is then coupled through capacitor C2 to the input pin 3 of the IC.

Following is a list of the sample values for various components employed in the specific embodiments of the invention shown in FIGS. 1 and 3. Those skilled in the art will recognize that other values and other embodiments are possible.

TABLE

| | | |
|---|---|---|
| 2 | R1 = 4.7 K | C1 = 0.1 uf |
| 3 | R2 = 160 K | C2 = 22 pf |
| 4 | R3 = 20 K | C3 = 0.1 uf |
| 5 | R4 = 20 K | C4 = 0.1 uf |
| 6 | R5 = 330 K | C5 = 0.047 uf |
| 7 | R6 = 160 K | C6 = 0.05 uf |
| 8 | R7 = 10 K potentiometer | C7 = 6.8 uf |
| 9 | R8 = 20 K | C8 = 100 uf |
| 10 | R9 = 30 K | C9 = 0.1 uf |
| 11 | R10 = 100 K | C10 = 330 pf |
| 12 | R11 = 100 | C11 = 2.2 uf |
| 13 | R12 = 10 K variable | C12 = 150 uf |
| 14 | R13 = 1 K | C13 = 22 uf |

TABLE-continued

| | | |
|---|---|---|
| 15 | R14 = 1 K | A1 = LM358M |
| 16 | R15 = 100 | A2 = LM324N |
| 17 | R16 = 2 K | A4 = LM358M |
| 18 | R17 = 2 K | D1 = IN914 |
| 19 | R18 = 39 K | Q1 = FET 2N5248 |
| 20 | R20 = 470 | Q2 = FET 2N5248 |
| 21 | R21 = 200 K | Q3 = 2N3904 |
| 22 | R22 = 680 K | |
| 23 | R23 = 150 K | IC = "567" |
| 24 | R24 = 510 K | |

The embodiment of FIG. 1 is particularly arranged for decoding a received independent sideband (ISB) AM stereo signal. Those skilled in the art will recognize, however, that the phase demodulation technique, the phase-locked loop variable bandwidth technique, and the stereo enabling, stereo bloom and muting techniques disclosed herein are applicable generally in decoders for other types of AM stereo signals. Accordingly, these techniques can be used in AM stereo receivers configured for other AM stereo systems.

While the invention has been particularly shown and described with reference to preferred embodiments thereof, it will be understood by those skilled in the art that numerous variations may be made without departing from the spirit and scope of the invention, which is evidenced in the appended claims.

What is claimed is:

1. An improved stereo radio receiver capable of operating in monophonic (mono) and stereophonic (stereo) reception modes, wherein the improvement comprises:

means for determining whether said receiver is in a condition for properly decoding stereo information from a received signal and for developing a control signal indicative thereof;

and means responsive to said control signal and controlling the translation of decoded stereo information in said receiver, for enabling such translation to begin at a selected perceptible time after said control indicates that the receiver is in a condition for properly decoding stereo information, thereby intentionally delaying the beginning of translation of decoded stereo information in said receiver:

whereby said receiver intentionally initially operates in its mono mode upon being tuned to a stereo station and before changing to its stereo mode.

2. A stereo receiver according to claim 1 wherein said receiver includes a stereo information decoder having a reference signal information decoder having a reference signal source which becomes synchronized to the carrier frequency of the received intermediate-frequency (IF) signal when said receiver is tuned to a station, and further having a stereo difference signal translation channel, wherein said determining means is a detector which detects when said signal source is properly synchronized to a supplied IF signal, and wherein said control signal responsive means enables translation of the stereo difference signal in said signal translating channel to begin after said intentional selected time delay.

3. An improved stereo radio receiver capable of operating in monophonic (mono) and stereophonic (stereo) reception modes, and including a stereo information decoder having a reference signal source which becomes synchronized to the carrier frequency of the received intermediate frequency (IF) signal when said receiver is tuned to a station, and further having a stereo difference signal translating channel, wherein the improvement comprises:

means for detecting when said reference signal source is properly synchronized to a received IF signal and for developing a control signal indicative thereof;

and means, responsive to said control signal, for enabling the translation of signals in said stereo difference signal translating channel after an intentional perceptible delay measured from the time when said control signal indicates that the receiver is in a condition for properly decoding stereo information, and further for causing said reference signal source to operate in a first mode until properly locked to the carrier of the received IF signal and, after said delay, to then operate in a second and different mode.

4. A stereo receiver according to claim 3 wherein said reference signal source is a phase-locked loop (PLL).

5. An improved stereo radio receiver capable of operating in monophonic (mono) and stereophonic (stereo) reception modes, and having a stereo information decoder which includes a phase-locked loop (PPL) which becomes synchronized with respect to the carrier frequency of the received intermediate-frequency (IF) signal when said receiver is tuned to a station and which further includes a stereo difference signal translating channel, wherein the improvement comprises:

means for detecting when said PLL is properly synchronized to a supplied IF signal and for developing a control signal indicative thereof;

a controllable impedance network coupled in the control loop of said PLL, for controlling the synchronizing characteristic of said PLL, and in series in said stereo difference signal translating channel, for controlling the translation of the stereo difference signal in said channel, and including a controlled device for changing the impedance presented by said network from a first value to a second value;

means for intentionally delaying said control signal for a selected perceptible time interval prior to applying said signal to said controlled device, thereby causing said PLL to operate in a first mode until properly locked to the carrier of the supplied IF signal and, after said selected time interval, to then operate in a second and different mode, and thereby also enabling translation of said stereo difference signal in said signal translating channel after said selected time interval;

whereby said receiver initially operates in its mono mode upon being tuned to a station and after said PLL becomes synchronized, and then changes to its stereo mode after said selected time interval.

6. A stereo receiver according to claim 5, wherein said means for delaying delays said control signal by at least 0.5 second.

7. A stereo receiver according to claim 5 wherein said means for delaying delays said control signal by at least 1 second.

8. A stereo receiver according to claim 5 wherein said controlled device is a field effect transistor (FET) having a control terminal and a pair of other terminals, and wherein said delayed control signal is coupled to said control terminal, one of said pair of other terminals is coupled to a first point in said impedance network and the remaining one of said pair is coupled to a second point in said network, thereby controlling the impedance presented by said network.

9. An improved stereo radio receiver which includes a stereo information decoder, wherein the improvement comprises:

first means for developing a reference signal which becomes synchronized to the carrier frequency component of a received intermediate frequency (IF) signal when said receiver is tuned to a station;

second means for determining whether said receiver is in a condition for properly decoding stereo information from a received signal and for developing a control signal indicative thereof;

and third means, coupled to said first means and responsive to said control signal, for providing a signal translation path for decoded stereo difference information only after said control signal indicates the receiver is in a condition for properly decoding stereo information, and for also affecting the mode of operation of said first means so that said first means normally operates in a first mode and then changes to a second and different mode when said control signal indicates the receiver is in a condition for properly decoding stereo information from said received signal.

10. A stereo receiver according to claim 9 which further includes means for intentionally delaying said control signal as applied to said third means so as to delay the enabling of said stereo signal translation channel for a selected preceptible time after said control signal indicates that the receiver is in a condition for properly decoding stereo information;

whereby said receiver initially operates in a monophonic mode upon being tuned to a station and before changing to its stereo mode.

11. A stereo receiver according to claim 9 wherein said first means is a phase-locked loop (PLL) and said third means affects the control loop of said PLL, thereby causing said PLL to have said two modes of operation.

12. A stereo receiver according to claim 11 wherein said stereo information decoder, including said PLL, is implemented using a conventional "567" tone/frequency decoder integrated circuit.

* * * * *